US005585595A

United States Patent [19]

Dix

[11] Patent Number: 5,585,595

[45] Date of Patent: Dec. 17, 1996

[54] DEVICE FOR SIMULATING WEAPONS FIRING AND/OR HIT INDICATION

[75] Inventor: Ernst Dix, Bremerhaven, Germany

[73] Assignee: Comet GmbH Pyrotechnik-Apparatebau, Bremerhaven

[21] Appl. No.: 443,469

[22] Filed: May 18, 1995

[30] Foreign Application Priority Data

May 19, 1994 [DE] Germany ..... 9408259 U

[51] Int. Cl.[6] ..... F42B 4/18; F42B 8/00

[52] U.S. Cl. ..... 102/355; 102/502; 102/529

[58] Field of Search ..... 102/355, 502, 102/529

[56] References Cited

U.S. PATENT DOCUMENTS

| | | | |
|---|---|---|---|
| 4,299,170 | 11/1981 | Dix et al. | 102/355 |
| 4,656,092 | 4/1987 | Haman et al. | 428/402.2 |
| 5,018,450 | 5/1991 | Smith | 102/513 |
| 5,254,379 | 10/1993 | Kotsiopoulos | 428/35.7 |
| 5,353,712 | 10/1994 | Olson | 102/513 |

FOREIGN PATENT DOCUMENTS

| | | | |
|---|---|---|---|
| GM7219521 | 5/1972 | Germany | F41J 5/00 |
| 2551471A1 | 5/1977 | Germany | F42C 19/06 |
| 9017701U1 | 11/1991 | Germany | F42C 19/06 |
| 455572 | 7/1968 | Switzerland . | |

*Primary Examiner*—Peter A. Nelson
*Attorney, Agent, or Firm*—Deveau, Colton & Marquis

[57] ABSTRACT

Shots and hits are simulated with pyrotechnic indicator means e.g. in military maneuvers. For this purpose, devices are used which are designed for accommodating a plurality of pyrotechnic indicator means (15) . Each indicator means (15) can individually be ignited electrically. To this end, an ignition device is provided which has ignition connectors (16) leading to the ignition contacts of each indicator means (15). In known devices of this type making a contact between the indicator means (15) and the ignition connectors (16) requires relative high expenditure of time. Furthermore, faulty connections cannot be excluded. As a result, reloading the device becomes time-consuming and unreliable.

The device according to the invention provides that either each ignition connector (16) or each indicator means (15) is provided with at least one annular circumferential contact. As a result, it is not necessary to take care that the indicator means (15) assumes a certain relative position relative to the ignition connector (16) during the process of reloading. On the contrary, an electric connection is always made due to the annular contact or the annular contacts, and ignition connectors (16) or indicator means (15).

The device according to the invention is particularly suitable for indicator means (15) which can simulate shots from a cannon of a tank, or which can create an optical signal, e.g. a colored smoke signal, for hit indication.

23 Claims, 3 Drawing Sheets

DEVICE FOR SIMULATING WEAPONS FIRING AND/OR HIT INDICATION

DESCRIPTION

Figure 1:
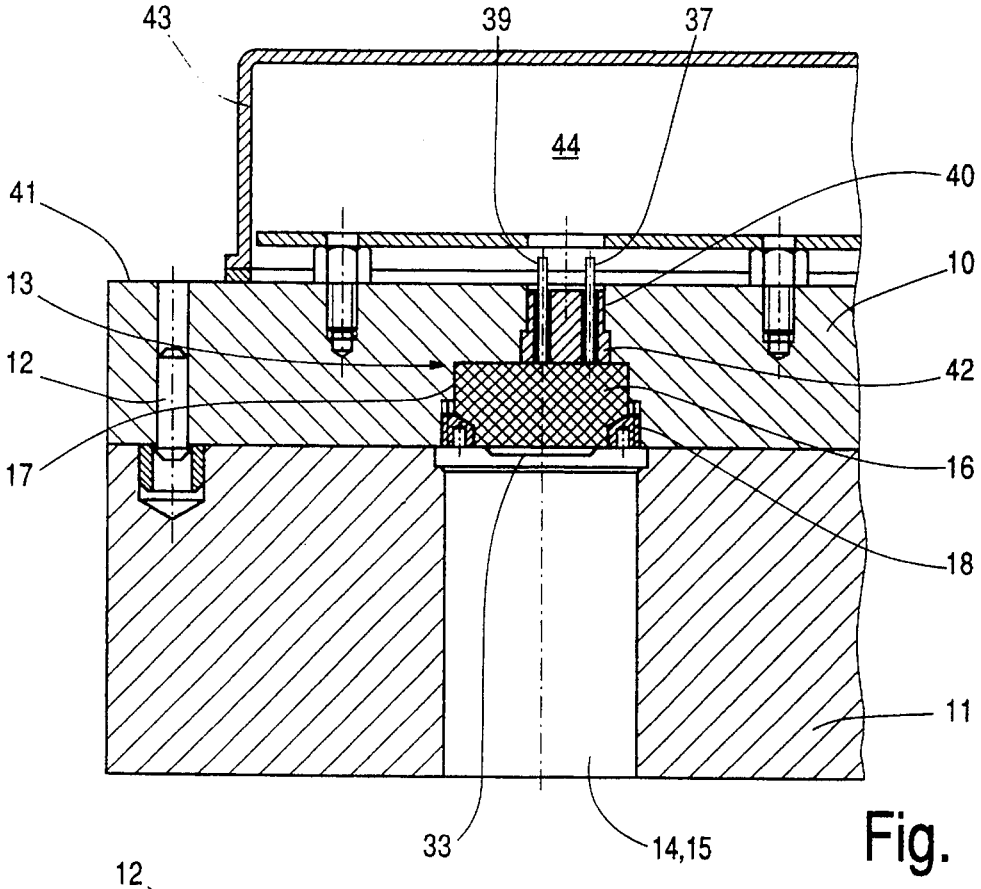

The invention relates to a device for simulating weapons firing and/or hit indication according to the generic terms of Claims 1, 8, 11 and 13.

Due to various reasons blank ammunition, specifically so-called indicator ammunition, is used for military maneuvers. With this indicator ammunition, shots of a cannon of, for example, a tank are simulated by pyrotechnic means, or an optical signal for hit indication is generated, for example a colored smoke signal.

Known devices of this type are provided with an accommodation for a plurality of pyrotechnic indicator means. These are selectively ignited electrically by means of electric ignition devices. Each ignition device is electrically connected to the individual indicator means via one respective ignition connector. The known devices of this kind have a number of drawbacks: To make an electrical connection, which normally has two contacts from each pyrotechnic indicator means to the respective ignition connector, the respective indicator means has to be arranged in the accommodation assuming a certain relative position. This requires a time-consuming process of reloading. A faulty relative position of certain indicator means in the accommodation results in that the respective pyrotechnic indicator means cannot be ignited. Furthermore, the pyrotechnic indicator means create a recoil which can affect the contacts of the ignition connector in such a manner that no electrical contact to the reloaded indicator means can be made. Finally, in particular devices which are mounted on tanks, for example when driving through mud, are subjected to humidity which can penetrate into the ignition device and impede the operation of the ignition device. For all the above reasons there is a considerable danger of misfire in known devices.

The invention is based on the object to create a device for simulating weapons firing and/or hit indication, in which misfire is reliably avoided.

A device for attaining this object is provided with the features of Claim 1. As a result of each ignition connector and/or each indicator means being connected to an annular contact, it is not necessary to take care during the loading of the device that the indicator means assumes a certain position relative to the ignition connector. On the contrary, an electrical connection is always made, for example, by the annular contact arranged on the ignition connector, and the contact on the indicator means assigned thereto. The contact on the indicator means merely needs to be designed as a pin or as a point. The annular contact may alternatively also be arranged on the indicator means so that the ignition connector is provided with a pin-shaped or dot-shaped contact. It is, however, also conceivable to provide an annular contact on the ignition connector as well as on the indicator means.

The circumferential contact is preferably designed as an annular contact. This annular contact concentrically surrounds a second central contact (center contact). The radius of the annular contact is preferably approximately equal to the distance from the dot-shaped or pin-shaped contact to the center contact on the indicator means. In this manner it is ensured that the indicator means can be inserted into a corresponding accommodation of the device in any possible position during the process of reloading, and that both contacts on the indicator means and on the ignition connector still make an electrical connection with one another.

A further device for attaining the object is provided with the features of Claim 8, according to which the indicator means and/or ignition connectors are provided with flexible contacts. The flexible contacts absorb a recoil during the ignition of the pyrotechnic indicator means and compensate tolerances. The contacts are thereby temporarily pressed into, for example, the ignition connectors. After the pyrotechnic indicator means has burned down, or reloading takes place, the contacts of the ignition connectors spring back, so that a reliable electrical contact to the reloaded indicator means is made.

The contacts in the ignition connectors are arranged so as to spring back. The contacts themselves need not be designed springably.

In the preferred embodiment of the invention, the ignition connectors are provided with a base made from a flexible material. In this case, the springing back of the contacts is effectuated in a simple manner by means of the flexible material of the base. Such ignition connectors can be easily provided with backspringing contacts.

A further device for attaining the object has the features of Claim 11. In this case, the contacts of the ignition connectors are harder than the contacts of the indicator means. As a result, it is ensured that the contacts of the indicator means adapt to the contacts of the ignition connectors, if necessary, by a plastic deformation further to a recoil or deviations within the tolerance of the indicator means. The contacts of the ignition connector, on the other hand, are not impaired, which ensures a safe electrical contact with the new, reloaded pyrotechnic indicator means.

A further device for attaining the object has the features of Claim 13 according to which the ignition connectors are tightly fitted in a plate-shaped accommodation. In this manner, a protection of the ignition device from e.g. penetrating humidity is provided in a particularly simple manner by means of the ignition connection.

In a preferred embodiment of the invention, the base of each ignition connector is again formed from a flexible material which is inserted into the corresponding plate-shaped accommodation with overmeasure. This overmeasure causes a flexible pretension of the base as a result of which the base tightly fits the plate-shaped accommodation and the contacts with its contact surfaces. This type of sealing of the electrical ignition device by means of the ignition connectors also effectuates a backspringing arrangement of the contacts in the ignition connectors, so that, at the same time, the insulation of the ignition connectors from the electrical ignition device, and the backspringing mounting of the contacts in the ignition connectors is effectuated by means of the flexible ignition connectors.

Figure 2:
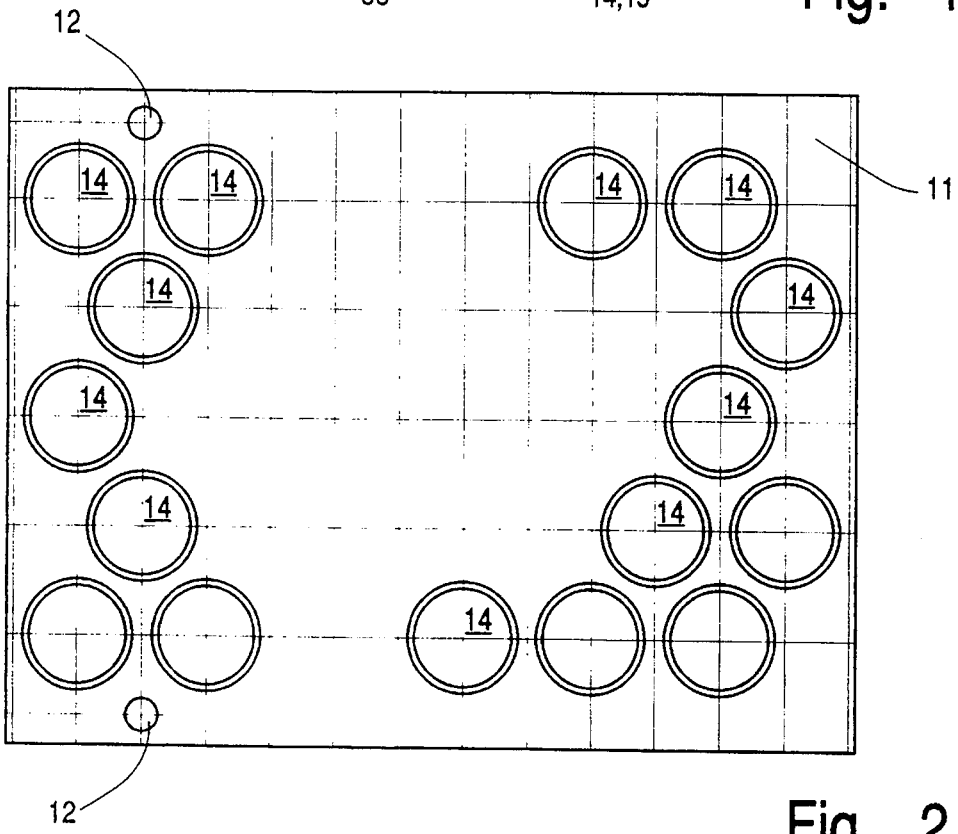
Figure 3:
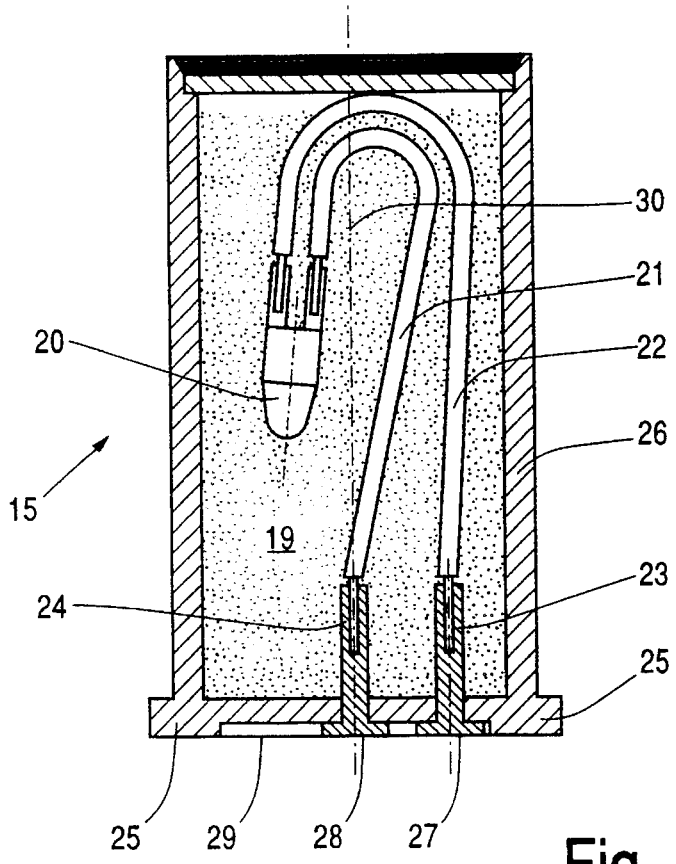
Figure 4:
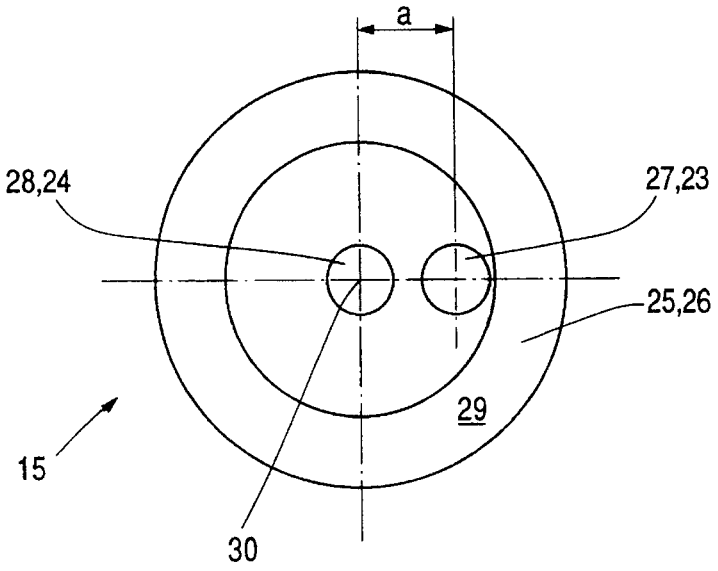
Figure 5:
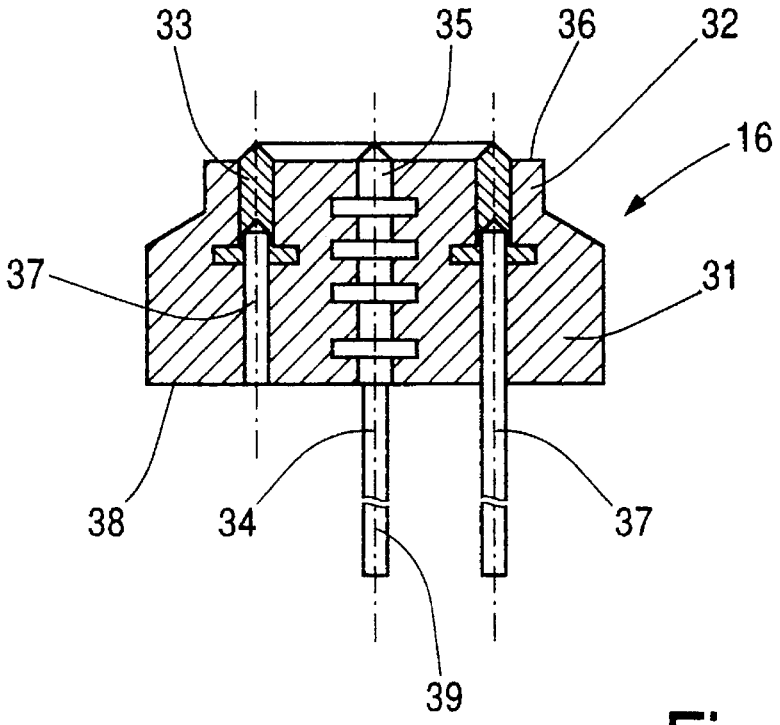
Figure 6:
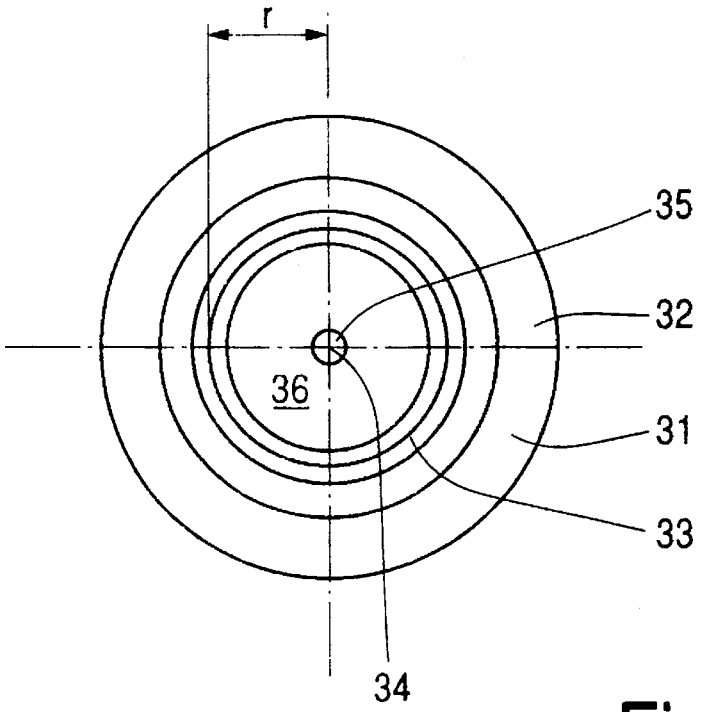

A preferred embodiment of the device according to the invention will be described hereinbelow with reference to the drawings. In these:

FIG. 1 shows a partial cross-section through the device,

FIG. 2 shows a reduced representation of the ground plan on an accommodating plate for a plurality of pyrotechnic indicator means in the opened device, FIG. 3 shows a longitudinal section through a pyrotechnic indicator means, FIG. 4 shows a view IV of a rear side of the pyrotechnic indicator means, FIG. 5 shows a longitudinal section through the ignition connectors, and FIG. 6 shows a view VI of a front side of the ignition connector.

The shown device serves for imitating shots without ammunition from e.g. a cannon of a tank in military training. Thereby, flash, smoke and bang of a shot without ammunition are simulated pyrotechnically in a realistic manner. For this purpose, the device is attached to the outside of the tank.

The device is provided with two accommodating plates 10 and 11 which are connected to one another on one side by hinges not shown in the drawing. The hinges make it possible to pivot the accommodating plates 10 and 11 apart for reloading the device. In the operating position, the accommodating plates 10 and 11 are folded up. The accommodating plates 10 and 11 are held together in the operating position of the device by means of closures which are not shown either.

The accommodating plates 10 and 11 are aligned relative to one another in their predetermined relative position by guide means 12 (FIG. 1 and 2).

Each of the accommodating plates 10 and 11 is provided with a relatively large number of accommodating bores 13 and 14 distributed over the base in a grid-like manner. The shown device is provided with thirty accommodating bores 14 in the lower accommodating plate 11 (FIG. 2), and thirty accommodating bores 13 in the (upper) accommodating plate 10. The accommodating bores 13 and 14 extend through the entire accommodating plate 10 or 11 with a varying diameter and are thus designed as graded through-holes.

A pyrotechnic indicator means 15 is arranged in each accommodating bore 14 of the (lower) accommodating plate 11. This indicator means 15 serves for creating the flash, smoke and, if appropriate, the bang which simulate the cannon fire. Normally, the accommodating bores 14 are provided with (in this case: thirty) identical indicator means 15. It is also conceivable to provide individual bores 14 with other indicator means, for example such for hit indication.

Each indicator means 15 is assigned an ignition connector 16 which is connected to an electrical ignition device. The respective ignition connectors 16 are arranged in a section 17 of the accommodating bore 13 in the accommodating plate 10, the section 17 being directed towards the indicator means 15 (and having a larger diameter). The respective ignition connector 18 is held in the section 17 of the accommodating bore 13 in a fixedly clamped manner by means of a fixing ring 18.

The ignition of the pyrotechnic indicator means 15 is effected electrically. For this purpose, a fuse 20 is embedded in the pyrotechnic charge 19 of the respective indicator means 17. Two electric conductors 21 and 22 serve for igniting the fuse 20, the electric conductors being connected to the fuse 20, on the one hand, and to separate contacts 23 and 24, on the other (FIG. 3). The contacts 23 and 24 are passed through the rear wall 25 of a cylindrical housing 26 which surrounds the pyrotechnic charge 19. Each contact 23 and 24 is provided with a circular contact surface 27 and 28, which is exposed on the rear side 29 of the rear wall 25. The contact 24 is situated on the longitudinal middle axis 30 of the indicator means 15 with its contact surface 28 (FIG. 4).

The ignition connector 16 is provided with a cylindrical base 31 made from a flexible material, e.g. rubber, silicone, or polyurethane preferably having a Shore hardness between 50 and 90. An annular contact 33 is embedded in the forward part 32 of the base 31, said forward part being directed towards the indicator means 15. Furthermore, a second contact, specifically a center contact 35, is situated in the middle of the base 31 and thus on the longitudinal middle axis 34 of the ignition connector 16. The annular contact 33 extends concentrically relative to the center contact 35 and has a radius r that corresponds to the distance a of the contacts 23 and 24 on the indicator means 15 (FIG. 6 and 4). Free ends of the annular contact 33 and the center contact 35 project from the front side 36 of the ignition connector 16, said front side 36 being directed towards the rear side 29 of the indicator means 15. The free projecting ends of the annular contact 33 and the center contact 35 have a tapered design. In this way, the annular contact 33 and the middle contact 35 of the ignition connector 16 exert high surface pressure on the contact surfaces 27 and 28 of the contacts 23 and 24 of the indicator means 15. The tips of the annular contact 33 and the center contact 35 press into the contact surfaces 27 and 28 of the contacts 23 and 24 for making a safe contact between the indicator means 15 and the ignition connector 16.

As a result of the assignment of the annular contact 33 of the ignition connector 16 to the eccentric contact 23 on the indicator means, the indicator means 15 can be inserted into the accommodating bore 14 in the accommodating plate 11 in any possible relative position about the longitudinal axis 30, while the contact 13 of the accommodating plate 11 always has an electric contact with the eccentric contact 23. Equally, a connection between the central contact 24 and the center contact 35 is made in any relative position of the indicator means 15 in the accommodating plate 11.

The annular contact 33 and the center contact 35 consist of a material that is harder than the contacts 23 and 24. As a result, it is ensured that the tips of the annular contact 33 and the center contact 35 do not become blunt after a while, on the one hand, and the tips of the annular contact 33 and the center contact 35 can press into the contact surfaces 27 and 28 of the contacts 23 and 24, on the other. It is furthermore ensured that the contacts 23 and 24 of the indicator means 15 are impaired by e.g. the recoil during ignition of the indicator means 15, but not the constantly used annular contact 33 and the center contact 35 of the ignition connector 16.

As a result of the base 31 of each ignition connector 16 being made from a flexible material two things are achieved: Firstly, the annular contact 33 and the center contact 35 are mounted in the base 31 in a backspringing manner. Secondly, the respective ignition connector 16 can be embedded in the section 17 of the accommodating bore with a pretension, as a result of which the ignition connector seas the contact surface of the base 31 with the section 17 of the accommodating bore 13 and, at the same time, the annular contact 33 and the center contact 35 are impermeably embedded in the base 31.

For simplifying the production of the ignition connector 16, the annular contact 33 is provided with two contact pins 37. Both contact pins 37 project beyond the rear side 38 of the base 31. After the production of the ignition connector 16, a contact pin is severed approximately flush with the rear side 38 so that only one contact piece 37 projects from the rear side 38 of the base 31 (FIG. 5). The contact pins 37 and 39 of the ignition connector 16 are passed through a rearward section 40 (which has a comparatively smaller diameter) of the accommodating bore 13 to such an extent that free ends of the contact pins 37 and 39 project from the rear wall 41 of the upper accommodating plate 40 (FIG. 1). In the region of the section 40 of the accommodating bore 13 an insulation of the free contact pins 37 and 39 is effected by an insulating body 42 which surrounds the contact pins 37 and 39 (FIG. 1).

The free ends of the contact pins 37 and 39 of each ignition connector 16 project into an installation room 44 formed by a cover 43 behind the rear wall 41. In this fluid-tight installation room 44, the contact pins 37 and 39 of all ignition connectors 16 are connected by lines (not shown) with an electric ignition device (equally not shown in FIG. 1). This ignition device controls the selective ignition of the indicator means 15 and supplies the fuse for igniting the pyrotechnic charge 19 with the required ignition current.

I claim:

1. A device for simulating weapons firing and/or hit indication, said device comprising a plurality of pyrotechnic indicator means which are connected to an electric ignition device for selectively igniting the indicator means, wherein each indicator means is assigned an ignition connector of the electric ignition device, and wherein the respective indicator means is electrically connected to the corresponding ignition connector by at least two contacts, wherein each ignition connector is provided with at least one circumferential contact.

2. The device as claimed in claim 1, wherein each circumferential contact is designed as an annular contact.

3. The device as claimed in claim 2, wherein the annular contact concentrically surrounds a central contact.

4. The device as claimed in claim 3, wherein the annular contact and the central contact are arranged on a front side of the ignition connector, said front side facing the indicator means, such that free ends of the central contact and the annular contact project from the from side of the ignition connector.

5. The device as claimed in claim 1, wherein each indicator means is provided with a central contact and an eccentric contact on a rear side facing the ignition connector.

6. The device as claimed in claim 5, wherein the eccentric contact on the indicator means is a distance (a) from the central contact of the indicator means which corresponds to the radius (r) of the annular contact on the respective ignition connector.

7. The device as claimed in claim 6, wherein the contacts of the indicator means have dot-shaped or circular contact surfaces, and wherein said central contact of the ignition connector has a dot-shaped or pin-shaped design with a pointed contact surface.

8. A device for simulating weapons firing and/or hit indication, said device comprising a plurality of pyrotechnic indicator means which are connected to an electric ignition device for selectively igniting the indicator means, wherein each indicator means is assigned an ignition connector of the electric ignition device, and wherein the respective indicator means is electrically connected to the corresponding ignition connector by at least two contacts, wherein the contacts are springably disposed in at least the ignition connectors.

9. The device as claimed in claim 8, wherein the contacts in the ignition connectors are mounted backspringingly or flexibly movable to-and-fro.

10. The device as claimed in claim 8, wherein the ignition connectors are provided with a base made from a flexible material for mounting the contacts.

11. A device for simulating weapons firing and/or hit indication said device comprising a plurality of pyrotechnic indicator means which are connected to an electric ignition device for selectively igniting the indicator means, wherein each indicator means is assigned an ignition connector of the electric ignition device, and wherein the respective indicator means is electrically connected to the corresponding ignition connector by at least two contacts, wherein the contacts of the ignition connectors are harder than the contacts of the indicator means.

12. The device as claimed in claim 11, wherein the contacts of the indicator means have larger contact surfaces than the contacts of the ignition connectors.

13. A device for simulating weapons firing and/or hit indication, said device comprising a plurality of pyrotechnic indicator means arranged in at least one accommodating plate, said pyrotechnic indicator means being connected to an electric ignition device for selectively igniting the indicator means, each indicator means being assigned an ignition connector of the electric ignition device, and the respective indicator means being electrically connected to the corresponding ignition connector by at least two contacts, wherein the ignition connector is tightly fitted in the accommodating plate.

14. The device as claimed in claim 13, wherein each ignition connector has a base and wherein the contacts of the ignition connector are mounted humidity-proof in the base of each ignition connector.

15. The device as claimed in claim 14, wherein the bases of the ignition connectors are tightly fitted in respective accommodating bores of the accommodating plate.

16. The device as claimed in claim 15, further characterized in that the base of each ignition connector is formed from a flexible material which is arranged at a flexible pretension in the respective accommodating bore for a humidity-proof contact to the wall of the accommodating bore and to the other contacts.

17. A device for simulating weapons firing and/or hit indication, said device comprising a plurality of pyrotechnic indicator means which are connected to an electric ignition device for selectively igniting the indicator means, wherein each indicator means is assigned an ignition connector of the electric ignition device, and wherein the respective indicator means is electrically connected to the corresponding ignition connector by at least two contacts, wherein each indicator means is provided with at least one circumferential contact.

18. The device as claimed in claim 17, wherein each circumferential contact is designed as an annular contact.

19. The device as claimed in claim 18, wherein the annular contact concentrically surrounds a central contact.

20. The device as claimed in claim 19 wherein the annular contact and the central contact are arranged on a rear side of the indicator means facing the ignition connector such that free ends of the central contact and annular contact of the indicator means project from the rear side of the indicator means.

21. The device as claimed in claim 20, wherein each ignition connector is provided with a central contact and an eccentric contact on a from side of the ignition connector facing the indicator means.

22. The device as claimed in claim 21 wherein the eccentric contact on the ignition connector is a distance (a) from the central contact of the ignition connector which corresponds to the radius (r) of the annular contact on the respective indicator means.

23. The device as claimed in claim 22 wherein the contacts of the ignition connector have dot-shaped or circular contact surfaces, and wherein said central contact of the indicator means has a dot-shaped or pin-shaped design with a pointed contact surface.

* * * * *